US009939147B2

(12) United States Patent
Booij et al.

(10) Patent No.: US 9,939,147 B2
(45) Date of Patent: Apr. 10, 2018

(54) ACOUSTIC LIGHTING TILE

(71) Applicant: PHILIPS LIGHTING HOLDING B.V., Eindhoven (NL)

(72) Inventors: Silvia Maria Booij, Eindhoven (NL); Ronald Cornelis De Gier, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 113 days.

(21) Appl. No.: 15/031,440

(22) PCT Filed: Nov. 4, 2014

(86) PCT No.: PCT/EP2014/073614

§ 371 (c)(1),
(2) Date: Apr. 22, 2016

(87) PCT Pub. No.: WO2015/071130

PCT Pub. Date: May 21, 2015

(65) Prior Publication Data

US 2016/0258615 A1 Sep. 8, 2016

(30) Foreign Application Priority Data

Nov. 18, 2013 (EP) ..... 13193286

(51) Int. Cl.
*F21V 1/00* (2006.01)
*F21V 33/00* (2006.01)
(Continued)

(52) U.S. Cl.
CPC ..... *F21V 33/006* (2013.01); *E04B 1/8209* (2013.01); *E04B 9/001* (2013.01);
(Continued)

(58) Field of Classification Search
CPC ..... F21V 33/006; F21V 3/00; F21V 7/0008; F21V 7/06; F21S 4/20; F21S 4/00; E04B 1/8209; E04B 9/001; E04B 9/32
(Continued)

(56) References Cited

U.S. PATENT DOCUMENTS 3,321,877 A 5/1967 Alexieff
3,409,766 A 11/1968 Meckler
(Continued)

FOREIGN PATENT DOCUMENTS

EP 2573461 A1 3/2013
EP 2650599 A1 10/2013
(Continued)

*Primary Examiner* — Elmito Breval
*Assistant Examiner* — Naomi M Wolford

(57) ABSTRACT

An acoustic lighting tile (100) comprises a cavity (110) having a side wall (120) forming an opening in the cavity (110). An acoustic element (130) absorbs sound incident to the cavity (110). A light source carrier (140) is arranged along the side wall (120) and extends a first distance (D1) along a horizontal direction into the cavity (110). A light source (150) is mounted on the Slight source carrier (140) and emits light (L1, L2, L3) in a vertical main direction into the cavity (110), away from the opening of the cavity (110). A reflective surface (160) reflects at least a subset of the light (L1, L2, L3) emitted by the light source (150) towards the opening. A diffusing element (170) at least partially covers the opening at a second distance (D2) from the light source carrier (140) and diffuses light passing through the opening. The second distance (D2) is at least as large as the first distance (D1). The distance (D2) between the light source carrier (140) and the diffusing element (170) provides a mixing space which facilitates provision of a more uniform illumination.

15 Claims, 2 Drawing Sheets

(51) Int. Cl.

| | |
|---|---|
| ***E04B 9/00*** | (2006.01) |
| ***F21V 7/00*** | (2006.01) |
| ***F21S 4/20*** | (2016.01) |
| ***E04B 1/82*** | (2006.01) |
| ***F21S 4/00*** | (2016.01) |
| ***F21V 3/00*** | (2015.01) |
| ***F21V 7/06*** | (2006.01) |
| *E04B 9/32* | (2006.01) |
| *F21Y 115/10* | (2016.01) |
| *F21Y 101/00* | (2016.01) |

(52) U.S. Cl.
CPC . *F21S 4/00* (2013.01); *F21S 4/20* (2016.01); *F21V 3/00* (2013.01); *F21V 7/0008* (2013.01); *F21V 7/06* (2013.01); *E04B 9/32* (2013.01); *F21Y 2101/00* (2013.01); *F21Y 2115/10* (2016.08)

(58) Field of Classification Search
USPC ..... 362/235
See application file for complete search history.

(56) References Cited

U.S. PATENT DOCUMENTS

| | | | | |
|---|---|---|---|---|
| 3,655,961 | A * | 4/1972 | Hover | E04B 9/02 362/149 |
| 5,782,551 | A | 7/1998 | Capaul | |
| 7,229,198 | B2 * | 6/2007 | Sakai | G02B 6/0051 362/225 |
| 2004/0070967 | A1 | 4/2004 | Kennedy | |
| 2005/0116667 | A1 | 6/2005 | Mueller et al. | |
| 2013/0182430 | A1 * | 7/2013 | Wu | F21V 7/0008 362/235 |
| 2013/0182431 | A1 * | 7/2013 | Wu | F21V 7/0016 362/235 |
| 2015/0233542 | A1 * | 8/2015 | Li | F21V 7/0083 362/235 |
| 2015/0241023 | A1 * | 8/2015 | Kim | F21S 8/03 362/296.05 |

FOREIGN PATENT DOCUMENTS

| | | | | |
|---|---|---|---|---|
| EP | 2653775 | A1 | 10/2013 | |
| WO | WO 2007008801 | A2 * | 1/2007 | E04B 9/001 |
| WO | WO 2008146229 | A2 * | 12/2008 | F21V 7/0008 |
| WO | 2012042429 | A2 | 4/2012 | |
| WO | 2014187788 | A1 | 11/2014 | |
| WO | 2015000864 | A1 | 1/2015 | |

* cited by examiner

ACOUSTIC LIGHTING TILE

CROSS-REFERENCE TO PRIOR APPLICATIONS

This application is the U.S. National Phase application under 35 U.S.C. § 371 of International Application No. PCT/EP2014/073614, filed on Nov. 4, 2014, which claims the benefit of European Patent Application No. 13193286.5, filed on Nov. 18, 2013. These applications are hereby incorporated by reference herein.

FIELD OF THE INVENTION

The present invention generally relates to the field of acoustically absorbing lighting devices, and in particular to light emitting acoustic tiles (acoustic lighting tiles).

BACKGROUND OF THE INVENTION

The sound level in a room may be reduced by the use of acoustically absorbing tiles, also called acoustic tiles. Acoustic tiles are typically arranged in a grid system covering the ceiling of the room. In order to illuminate the room from the ceiling, lighting devices may for example be arranged on the outside of the acoustic tiles (i.e. on the side of the tiles facing the room), between the acoustic tiles in the grid or as dedicated lighting tiles replacing some of the acoustic tiles in the grid. Since lighting devices typically absorb less sound than acoustic tiles of similar dimensions, their presence in the ceiling may adversely affect the acoustic properties of the ceiling and may thereby adversely affect the sound level in the room. Therefore, a trade-off is typically made between desired acoustic properties and a desired illumination. In particular, in order to limit their impact on the overall acoustic properties of the ceiling, lighting devices often cover only small portions of the ceiling, while sound absorbing surfaces cover the major part of the ceiling. Such a design, however, causes restrictions on how the room may be illuminated.

One way to provide illumination in a grid system for acoustic tiles is to integrate light sources in the acoustic tiles. In EP 2573461 A1, an acoustical lighting assembly is disclosed comprising a substrate having acoustically absorbing properties, an open cavity having side surfaces and an opening, and solid state lighting-based components located in the cavity. The acoustical lighting assembly further comprises a rigid cover of the open cavity, the cover being transparent to at least one range of wavelengths emitted by the solid state lighting based components and arranged to be acoustically non-reflective. Thus, the light emitted by the solid state lighting-based components is extracted from the assembly through the cover and the sound can go through the cover and the cavity and be absorbed by the substrate.

However, it would be desirable to provide acoustic lighting tiles (i.e. light emitting acoustic tiles), with alternative and/or improved designs for facilitating provision of a desired illumination while maintaining a desired level of sound absorption.

SUMMARY OF THE INVENTION

It would be advantageous to provide an acoustic lighting tile overcoming, or at least alleviating, one or more of the above mentioned drawbacks. In particular, it would be desirable to facilitate provision of a desired illumination while maintaining a desired level of sound absorption.

To better address one or more of these concerns, an acoustic lighting tile having the features defined in the independent claim is provided. Preferable embodiments are defined in the dependent claims.

Hence, according to an aspect, an acoustic lighting tile is provided. The acoustic lighting tile comprises a cavity having at least one side wall arranged to form an opening in the cavity, an acoustic element adapted to absorb at least a subset of sound incident to the cavity, and at least one light source carrier arranged in the cavity along at least one of the at least one side wall. The at least one light source carrier extends a first distance along a horizontal direction into the cavity, and it is arranged to emit light in a vertical main direction into the cavity away from the opening of the cavity. The acoustic lighting tile comprises at least one light source mounted on the at least one light source carrier and arranged to emit light into the cavity, and at least one reflective surface arranged in the cavity and adapted to reflect at least a subset of the emitted light (i.e. at least a subset of the light emitted by the at least one light source into the cavity) towards the opening. The acoustic lighting tile comprises a diffusing element arranged to at least partially cover the opening at a second distance from the at least one light source carrier and adapted to at least partially diffuse light passing through the opening. The second distance is at least as large as the first distance.

On its way towards the opening of the cavity, a part of the light emitted by the light source may be obstructed and/or shadowed by the light source carrier. In order to reduce the impact of this obstruction of light on the spatial distribution of light passing through the diffusing element (i.e. via the opening of the cavity), the diffusing element at least partially covers the opening of the cavity at a distance from the light source carrier which is at least as large as the width of the light source carrier (measured as how long a distance the light source carrier extends along the direction into the cavity, e.g. along a direction transverse, such as at least approximately orthogonal, to the side wall along which the light source carrier is arranged). Such a reduction of the impact of the obstruction of light facilitates provision of a more (spatially) uniform illumination, which is normally desired in indoor illumination.

The diffusing element at least partially diffuses light passing through the opening of the cavity, which may improve uniformity of the spatial and/or angular distribution of the light output of the acoustic lighting tile. The diffusing element being arranged at the second distance from the light source carrier may create a mixing space between the light source carrier and the diffusing element for light emitted by the light source, which reduces the visibility of the shadow from the light source carrier from outside of the acoustic lighting tile.

The acoustic element increases the sound absorbing properties of the acoustic lighting tile and increases its usability as a replacement and/or a complement to regular acoustic tiles (i.e. acoustic tiles without light sources). Hence, the use of the acoustic element, in combination with the reduced impact of the obstruction of light, as described above, facilitates provision of a desired illumination while maintaining a desired level of sound absorption.

As described above, the at least one reflective surface may be adapted to reflect at least a subset of the emitted light (i.e. at least a subset of the light emitted by the at least one light source into the cavity) towards the opening of the cavity. Light reflected by the at least one reflective surface may for example arrive directly from the at least one light source or may already have been redirected/reflected one or more times before arriving at the at least one reflective surface. For example, the acoustic lighting tile may comprise several reflective surfaces and light from the at least one light source may be reflected several times before reaching the opening in the cavity. The use of multiple reflections and/or multiple reflective surfaces may facilitate provision of a more uniform illumination. In some embodiments, the at least one light source carrier may extend a third distance from the at least one of the at least one side wall into the cavity and the second distance may be at least as large as the third distance. The at least one light source carrier may be arranged/suspended along a side wall via e.g. a bracket, and may extend further into the cavity than the width of the at least one light source carrier itself, i.e. it may extend a third distance into the cavity corresponding to the combined width of the at least one light source carrier and the bracket. The second distance may be at least as large as the third distance to reduce the impact of the obstruction of light caused by both the bracket and the at least one light source carrier.

According to an embodiment, the cavity may comprise a back wall. In the present embodiment, at least one of the at least one side wall may comprise a first portion extending at least partway between the back wall and the at least one light source carrier, and a second portion extending at least partway between the at least one light source carrier and the diffusing element. In the present embodiment, the second portion may be slanted relative to the first portion, i.e. the second portion may be oriented in such a way that it forms an angle relative to the first portion. The second portion being slanted relative to the first portion may increase mechanical stiffness (and/or durability/sturdiness) of the acoustic tile.

According to an embodiment the second portion may be slanted inwards towards an interior of the cavity, relative to the first portion. In applications where the acoustic lighting tile is arranged alongside similar acoustic lighting tiles, e.g. on a wall or in a ceiling, the inward slant of the second portion may reduce visibility of height differences between neighboring tiles, in particular when the light sources of the acoustic lighting tiles are switched off. Hence, the inward slant of the second portion may allow for use of acoustic lighting tiles with a larger variation of height/thickness.

According to an embodiment, the second portion may be slanted outwards away from an interior of the cavity, relative to the first portion. In applications where the acoustic lighting tile is mounted, e.g. in a ceiling or on a wall, alongside similar acoustic lighting tiles, this outward slant allows for a volume/space between the acoustic lighting tiles and behind the second portion to be hidden from view. Such a volume may be used for mounting the acoustic lighting tile. With the present embodiment, the distance between light emitting surfaces of neighboring acoustic lighting tiles may be reduced while still allowing such a volume/space for mounting purposes.

According to an embodiment, an edge portion of the second portion may be slanted relative to the portion of the second portion adjacent to the edge portion. The slant of the edge portion may further increase mechanical stiffness of the acoustic lighting tile.

In some embodiments, the second portion may be slanted outward away from an interior of the cavity, relative to the first portion, and the edge portion may be slanted inwards towards an interior of the cavity, relative to the portion of the second portion adjacent to the edge portion. In applications where the acoustic lighting tile is arranged alongside similar acoustic lighting tiles, e.g. on a wall or in a ceiling, the inward slant of the edge portion may reduce visibility of height differences between neighboring tiles, in particular when the light sources of the acoustic lighting tiles are switched off. Hence, the inward slant of the edge portion may allow for use of acoustic lighting tiles with a larger variation of height/thickness.

In some embodiments, the second portion may be slanted inwards towards an interior of the cavity, relative to the first portion, and the edge portion may be slanted outward away from an interior of the cavity, relative to the portion of the second portion adjacent to the edge portion.

According to an embodiment, at least a part of a rim of at least one of the at least one side wall may be folded and the diffusing element may be arranged in abutment to the fold of the rim. The fold of the rim increases the smoothness of a surface which is in contact with the diffusing element, and reduces the risk of tearing and/or damaging the diffusing element. The fold of the rim may increase mechanical stiffness of the rim and/or the acoustic lighting tile.

According to an embodiment, at least one of the at least one side wall may comprise a portion extending between the at least one light source carrier and the diffusing element (such as the second portion described above). In the present embodiment, at least part of the portion extending between the at least one light source carrier and the diffusing element may be at least partially light transmissive, i.e. light of at least some wavelengths/frequencies may pass through at least a part of this portion (the light may e.g. be diffused when passing through, or it may pass through unaffected). Light being allowed to pass through the portion extending between the at least one light source carrier and the diffusing element may increase the total area contributing to the light output of the acoustic lighting tile. In particular, in applications where multiple acoustic lighting tiles are arranged alongside each other, spaces between adjacent acoustic lighting tiles may be illuminated in this way. Hence, at least part of the portion extending between the at least one light source carrier and the diffusing element being at least partially light transmissive may allow multiple acoustic lighting tiles arranged alongside each other to provide a more uniform illumination.

According to an embodiment, the portion extending between the at least one light source carrier and the diffusing element may comprises at least one aperture, thereby making the portion at least partially light transmissive. The use of at least one aperture for making the portion extending between the at least one light source carrier and the diffusing element at least partially light transmissive allows for use of a wider range of materials in the portion extending between the at least one light source carrier and the diffusing element. In particular, the materials used need not be light transmissive/transparent themselves. This may allow use of less expensive and/or more durable materials.

According to an embodiment, the acoustic lighting tile may comprise a second diffusing element (such as a volume diffuser, e.g. a material containing particles or refractive index variations inside its volume causing scattering to take place in the volume of the material rather than at faces/surfaces of the material due to a surface structure) arranged on an outside, relative to the cavity, of the portion extending between the at least one light source carrier and the diffusing element. The second diffusing element may be adapted to at least partially diffuse light passing through (an at least partially light transmissive part of) the portion extending between the at least one light source carrier and the diffusing element. By diffusing light which passes through the portion extending between the at least one light source carrier and the diffusing element, the total area contributing to the light output of the acoustic lighting tile may be increased. In particular, in applications where multiple acoustic lighting tiles are arranged alongside each other, spaces between adjacent acoustic lighting tiles may be illuminated more uniformly using the second diffusing element.

The use of a second diffusing element may be particularly useful in embodiments where the portion extending between the at least one light source carrier and the diffusing element is made light transmissive via at least one aperture, since the second diffusing element may contribute to distributing light from the at least one aperture for providing a more uniform illumination.

In some embodiments, the at least one light source may be adapted to emit at least some of the light towards the second diffusing element (i.e. directly, rather than via the cavity and the at least one reflective surface), and the second diffusing element may be adapted to at least partially diffuse the light emitted towards the second diffusing element.

According to an embodiment, at least a portion of at least one of the at least one side walls may comprise metal. In some embodiments, at least a portion of at least one of the at least one side walls may be of metal, for example the portion extending between the at least one light source carrier and the diffusing element.

The use of metal in one or more of the side wall may increase the durability of the acoustic lighting tile and/or may facilitate manufacture thereof.

According to an embodiment, at least one of the at least one reflective surface may be curved, i.e. it may have a curved shape. The curved shape of the reflective surface(s) may allow for distributing/spreading light from the at least one light source more uniformly across the diffusing element (at least partially) covering the opening of the cavity, and may facilitate provision of a more (spatially) uniform light output of the acoustic lighting tile.

The reflective surface may for example be concave, i.e. it may bulge inwards. The reflective surface may for example be a parabolic reflector (and/or may have a parabolic cross section).

According to an embodiment, the acoustic lighting tile may comprise two light source carriers arranged at opposite sides of the cavity. Using light emitted from two opposite sides of the cavity provides a more uniform illumination.

In the present embodiment, at least one light source may be mounted on each of the two light source carriers, and may be adapted to emit light into the cavity. The two light source carriers may be arranged in the cavity along side walls of the cavity (or along parts/portions of a single side wall, the parts/portions being located at opposite sides of the cavity). The two light source carriers may extend distances along directions into the cavity which are at most as large as a first distance. The diffusing element may be arranged to at least partially cover the opening at a second distance from the two light source carriers, the second distance being at least as large as the first distance. The acoustic lighting tile may for example comprise two reflective surfaces, each associated with one of the light source carriers, the respective reflective surfaces reflecting at least a subset of the light emitted by the at least one light source mounted on the respective associated light source carrier.

In some embodiments, the acoustic lighting tile may be rectangular and may comprise four light source carriers arranged along respective four sides of the cavity.

According to an embodiment, the acoustic lighting tile may be rectangular, i.e. the cavity may have side walls (or parts/portions of a side wall) arranged at least approximately orthogonally in such a way that the side walls (or parts/portions of a side wall) form sides of a rectangle. In other words, the acoustic lighting tile may have a rectangular (or four-sided) cross section formed by the at least one side wall of the cavity. The rectangular shape of the acoustic lighting tile in the present embodiment facilitates arrangement of multiple acoustic lighting tiles (e.g. in a grid) to cover a surface such as a ceiling. In the present embodiment, the opening of the cavity may for example be rectangular.

According to an embodiment, the at least one light source may comprise a strip of multiple light sources arranged along at least one of the at least one side wall. The use of a strip of lighting devices my facilitate provision of a more uniform illumination and/or may facilitate manufacture of the acoustic lighting tile.

According to an embodiment, the at least one light source may comprise at least one solid state light source, e.g. one or more light emitting diodes.

It is noted that embodiments of the invention relates to all possible combinations of features recited in the claims.

BRIEF DESCRIPTION OF THE DRAWINGS

This and other aspects will now be described in more detail with reference to the appended drawings showing embodiments.

All the figures are schematic, not necessarily to scale, and generally only show parts which are necessary in order to elucidate the embodiments, wherein other parts may be omitted or merely suggested. Like reference numerals refer to like elements throughout the description.

DETAILED DESCRIPTION OF THE EMBODIMENTS

The present aspect will now be described more fully hereinafter with reference to the accompanying drawings, in which currently preferred embodiments are shown. This invention may, however, be embodied in many different forms and should not be construed as limited to the embodiments set forth herein; rather, these embodiments are provided for thoroughness and completeness, and fully convey the scope of the present aspect to the skilled person.

Figure 1:
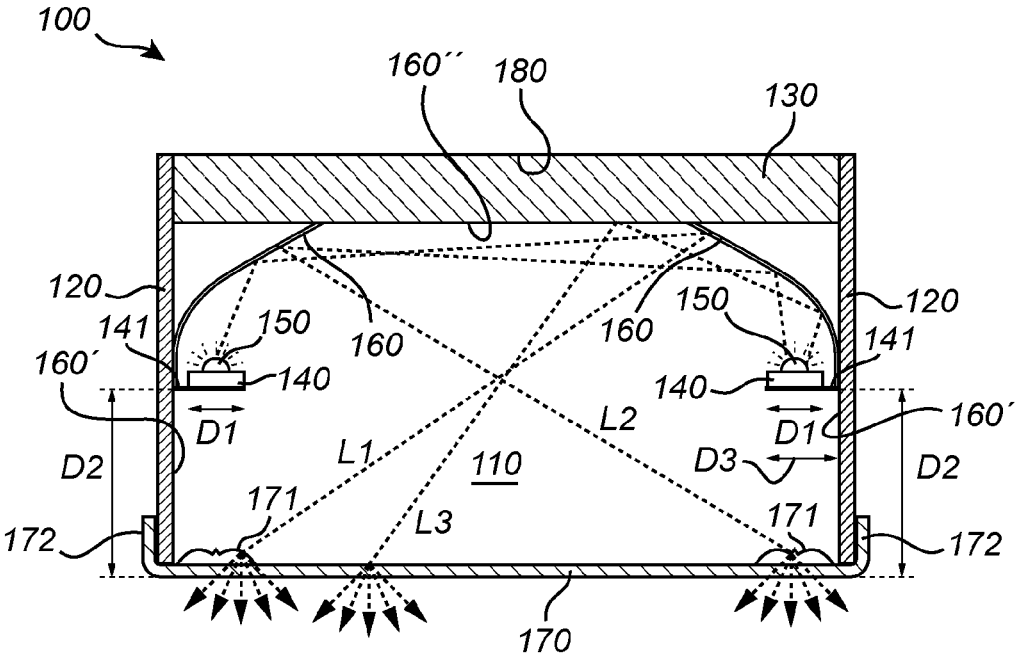
FIG. 1 shows a cross section of an acoustic lighting tile according to a first embodiment.

An acoustic lighting tile according to a first embodiment will be described with reference to FIG. 1 showing a cross section of the acoustic lighting tile. The acoustic lighting tile 100 comprises a cavity 110 having at least one side wall 120 arranged to form an opening in the cavity 110. The acoustic lighting tile 100 further comprises an acoustic element 130, at least one light source carrier 140, at least one light source 150, at least one reflective surface 160, and a diffusing element 170.

The cavity 110 comprises an open space at least partially enclosed by the at least one side wall 120. The at least one side wall 120 is exemplified in FIG. 1 by vertical walls 120 extending from a back wall 180 of the cavity 110, the side walls 120 forming an opening at the bottom of the cavity 110. The cavity 110 may for example have four vertical side walls 120 arranged in the shape of a rectangle forming a rectangular opening. In another example embodiment, one of these four side walls 120 may be 'missing' such that the cavity 110 is open both at a side and at the bottom. Example embodiments are envisaged in which one or more such 'missing' side walls of the acoustic lighting tile 100 may be replaced by side walls of other similar acoustic lighting tiles arranged adjacent the acoustic lighting tile 100. In another example embodiment the cavity may have a single circular side wall 120. Example embodiments are envisaged in which the side walls 120 are arranged at different angles than 90 degrees relative to the back wall 180, and in which the cavity 110 has any number of side walls 120. The back wall 180 and/or the at least one side wall 120 may for example be made of metal or plastic material.

The acoustic element 130 is adapted to absorb at least a subset of sound incident to the cavity 110. The acoustic element 130 is exemplified in FIG. 1 by an acoustically absorbing plate 130 arranged in the cavity 110, along the back wall 180, opposite the opening of the cavity 110. In other example embodiments, the acoustic element 130 may comprise parts/portions located along the side walls 120, e.g. in combination with a portion/part located along the back wall 180. The acoustic element 130 may comprise acoustically absorbing material (e.g. mineral wool such as glass wool or rock wool) and/or may have a shape/surface structure adapted for absorbing sound.

The at least one light source carrier 140 is arranged in the cavity 110 along at least one of the at least one side walls 120 of the cavity and extends a first distance D1 along a direction into the cavity 110. The at least one light source carrier 140 is exemplified in FIG. 1 by two printed circuit boards (PCBs) 140 arranged along side walls 120 on opposite sides of the cavity 110. Other light source carriers 140 are envisaged, such as other types of circuit boards or holders for different types of light sources (e.g. for tube lamps or incandescent lamps).

Each of the PCBs 140 in FIG. 1 extends a first distance D1 along a horizontal direction into the cavity 110, i.e. the PCBs 140 have a width D1 in a horizontal direction into the cavity 110. In the example arrangement shown in FIG. 1, the PCBs 140 are supported (or suspended) along the side walls 120 by pins (or any kind of bracket) 141 extending into the cavity 110. Hence, in the example arrangement shown in FIG. 1, the PCBs 140 extend further into the cavity 110 than the first distance D1, i.e. the PCBs 140 extend a third distance D3 into the cavity 110. In other example arrangements (such as the one shown in FIG. 3), the PCBs 140 may be attached directly to the side walls 120, and the first distance D1 may be the same as the distance a PCB 140 extends into the cavity 110.

The at least one light source 150 is exemplified in FIG. 1 by LEDs 150 mounted on the PCBs 140 and arranged to emit light upwards, in a vertical main direction into the cavity 110 (away from the opening of the cavity 110). The LEDs 150 may for example be arranged as two strips of multiple LEDs, the strips being mounted on the two PCBs 140, on opposite sides of the cavity 110. Other light sources 150 are envisaged, such as incandescent lamps or tube lamps. Example embodiments are also envisaged in which the LEDs 150 emit light in different directions, such as horizontally and/or diagonally into the cavity 110.

The at least one reflective surface 160 is exemplified in FIG. 1 by two reflectors 160 arranged in the cavity 110 and adapted to reflect light emitted by the LEDs 150. Other reflective surfaces are also envisaged, such as one or more optically reflective surfaces 160', 160" on parts/portions of the side walls 120, the acoustic element 130, and/or the back wall 180 (in case the acoustic element 130 does not entirely cover the back wall 180), e.g. provided via an optically reflective paint/coating.

The reflectors 160 shown in FIG. 1 are arranged on opposite sides of the cavity 110 and each of the reflectors 160 is arranged to reflect at least a subset of the light from the LEDs 150 towards the opening of the cavity 110. This is illustrated by first and second light rays L1, L2 in FIG. 1. The first light ray L1 is emitted by one of the light sources 150 and is reflected by one of the reflectors 160 towards another one of the reflectors 160. The first light ray L1 is then reflected towards the opening of the cavity 110. Analogously, the second light ray L2 is emitted by another one of the light sources 150 and is reflected by one of the reflectors 160 towards another one of the reflectors 160. The second light ray L2 is then reflected towards the opening of the cavity 110. The reflectors 160 are curved so as to distribute the light from the LEDs 150 across the opening of the cavity 110. Depending on the desired light output, the reflectors 160 may have different shapes. The reflectors 160 may for example be concave, and may have a parabolic shape.

Depending on the geometry of the acoustic lighting tile 100 and its components, some light from the light sources 150 may for example be reflected by the reflectors 160 before being reflected towards the opening of the cavity 110 via reflective surfaces 160', 160" on parts/portions of the side walls 120 and/or of the acoustic element 130. This is illustrated by a third light ray L3 which is reflected first by one of the reflectors 160 and then by a reflective surface 160" on the acoustic element 130 towards the opening of the cavity 110.

Similarly, some light from the light sources 150 may for example be reflected by reflective surfaces 160', 160" on parts/portions of the side walls 120 and/or of the acoustic element 130, before being reflected towards the opening of the cavity 110 by the reflectors 160.

The diffusing element 170 is arranged to at least partially cover the opening of the cavity 110 at a second distance D2 from the at least one light source carrier 140, and is adapted to at least partially diffuse light passing through the opening. The diffusing element 170 is exemplified in FIG. 1 by a surface sheet 170 arranged across the opening of the cavity 110 and in abutment to the lower ends of the side walls 120. The surface sheet 170 may be substantially acoustically non-reflective, i.e. sound incident to the cavity 110 may pass through the surface sheet 170 and may be absorbed by the acoustic element 130. The surface sheet 170 may diffuse light from the LEDs 150 passing through the opening of the cavity 110 in order to hide components present in the acoustic lighting tile 100. For example, the surface sheet 170 may diffuse light to prevent the individual LEDs 150 from being seen from outside the acoustic lighting tile 100, via the reflection given by the reflectors 160. The surface sheet 170 may for example be made of plastics, cloth and/or glass.

Figure 2:
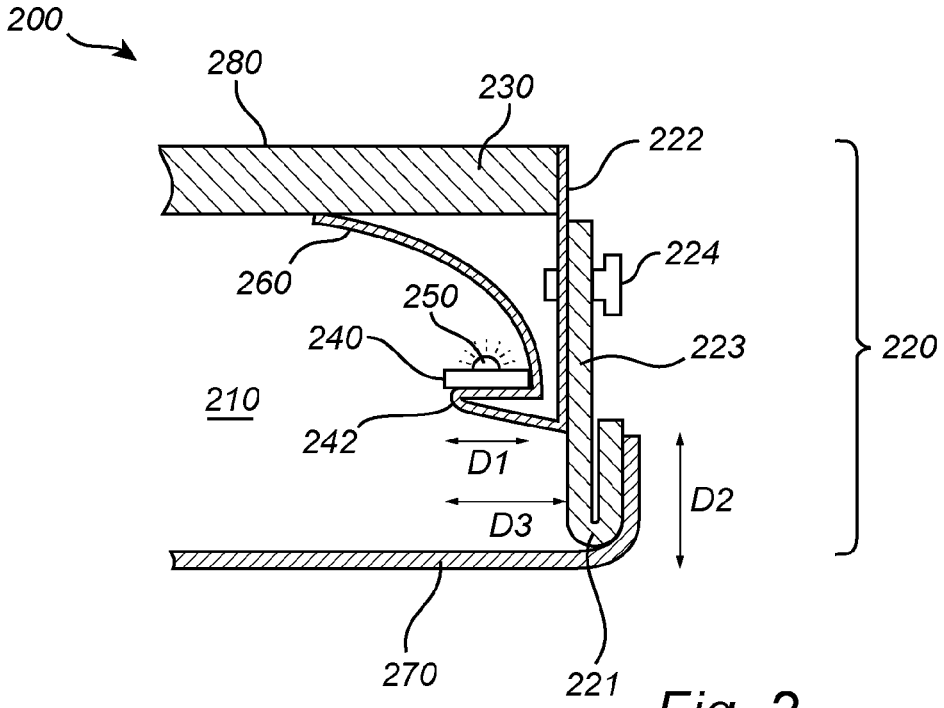
FIG. 2 shows a cross section of parts of an acoustic lighting tile according to a second embodiment.

The LEDs 150 emit light into the cavity 110 and towards the reflectors 160 from their locations along the side walls 120 of the cavity 110. As described above, the reflectors 160 may for example reflect this light towards the other reflector 160, the surface 160" on the acoustic element 130 and the surface sheet 170 at the opening of the cavity 110. On its way towards surface sheet 170 (e.g. via one or more reflections), at least part of the light emitted by the LEDs 150 is obstructed/shadowed by the PCBs 140, and possibly also by the LEDs 150 themselves. It is to be noted that the pins 141 via which the PCBs 140 are attached to the side walls 120 may be relatively thin, i.e. the pins 141 may extend a relatively short distance along the side walls 120 compared to the PCBs 140 and therefore do not obstruct a significant amount of light. By arranging the surface sheet 170 at a distance from the PCBs 140, the spatial distribution of light passing through the surface sheet 170 is affected to a lower extent by the obstruction of light caused by the PCBs 140, than it would be if the surface sheet 170 was arranged closer to the PCBs 140. In particular, by arranging the surface sheet 170 at a second distance D2 from the PCBs 140, at least as large as the width D1 of the PCBs 140 (measured in a horizontal direction from the side walls 120 into the cavity 110), light from the LEDs 150 may be reflected into portions of the cavity 110 below the PCBs 140, and the edge portions 171 of the surface sheet 170 located in a vertical direction below the PCBs 140 may be illuminated. In other words, by arranging the surface sheet 170 a second distance D2 from the PCBs 140, at least as large as the width D1 of the PCBs 140, the surface sheet 170 may be more uniformly illuminated and dark areas along the edge of the surface sheet 170 may be reduced. In case the pins 141 do obstruct a significant amount of light, the surface sheet 170 may for example be arranged at a second distance D2 from the PCBs 140, at least as large as the combined width D3 of the PCB 140 and the pins 141, to at least partially compensate for this additional obstruction of light. The use of acoustic lighting tiles 100, as described in relation to FIG. 1, in which the surface sheet 170 is more uniformly illuminated, may facilitate provision of a more (spatially) uniform illumination of the acoustic lighting tile 100. Moreover, the use of multiple reflections (via multiple reflective surfaces) to distribute the light from the light sources 150 across the surface sheet 170, as illustrated by the light rays L1, L2, L3, may facilitate provision of a more uniform illumination of the acoustic lighting tile 100, as compared to an acoustic lighting tile relying on a single reflection to distribute the light from the light sources. That the diffusing element 170 is arranged to at least partially cover the opening of the cavity 110 at a second distance D2 from the at least one light source carrier 140 means that any portion of the diffusing element 170 covering a portion of the opening of the cavity 110 is located at least a second distance D2 away from the light source carrier 140. The diffusing element 170 may for example comprise portions 172 located closer than the second distance D2 from the light source carrier 140, but which do not cover any portions of the opening of the cavity 110. An acoustic lighting tile according to a second embodiment will be described with reference to FIG. 2 showing a cross section of parts of the acoustic lighting tile. The acoustic lighting tile 200 shown in FIG. 2 may be similarly configured as the acoustic lighting tile 100 described with reference to FIG. 1, i.e. it comprises a cavity 210 with at least one side wall 220, an acoustic element 230, at least one light source carrier 240, at least one light source 250, at least one reflective surface 260, and a diffusing element 270.

However, in the acoustic lighting tile 200 shown in FIG. 2, at least a part of a rim 221 of the side wall 220 is folded, and the diffusing element 270 (e.g. surface sheet) is arranged in abutment to the fold of the rim 221. The fold of the rim 221 of the side wall 220 increases the smoothness of the rim 221 and reduces the risk of tearing of the diffusing element 270 and/or may serve to increase mechanical stiffness of the acoustic lighting tile 200.

In FIG. 2, the side wall 220 is exemplified by a side wall 220 which comprises a first part 222 extending between the back wall 280 of the cavity 210 and the light source carrier 240 (e.g. PCB), and a second part 223, attached to the first part 222, and extending between the light source carrier 240 and the diffusing element 270 (e.g. surface sheet). In the example embodiment shown in FIG. 2, the second part 223 is attached to the first part 222 via a screw 224, but other many other types of fastening means are envisaged, such as snap fit designs, pins, rivets and/or adhesives.

As in the acoustic lighting tile 100 shown in FIG. 1, the diffusing element 270 covers the opening of the cavity 210 at a second distance D2 from the light source carrier 240, the second distance D2 being at least as large as the width D1 of the light source carrier 240 (measured in a horizontal direction from the side wall 220 into the cavity 210). In FIG. 2, the light source carrier 240 is arranged along the side wall 220 via a bracket 242 extending from the side wall 220. In contrast to the pins 141 in FIG. 1, the bracket 242 may contribute to obstructing light from reaching the opening of the cavity 210. Hence, the second distance D2, i.e. the distance between the light source carrier 240 and the diffusing element 270 covering the opening may preferably be increased such that it is at least as large as the combined width D3 of the light source carrier 240 and the bracket 242 (measured in a horizontal direction from the side wall 220 into the cavity 210). Moreover, in case the bracket 242 extends (downwards) a distance between the light source carrier 240 and the diffusing element 270, it may potentially obstruct light also there, and the second distance D2 may be increased by ensuring that the distance between the bracket 242 and the diffusing element 270 is at least as large as the width of the light source carrier 240 (or as the combined width of the light source carrier 240 and bracket 242). The bracket 242 may fbr example be of metal or plastic material. In some example embodiments, the bracket 242 may be at least partially reflective so as to reflect light from the at least one light source 250, e.g. towards the opening of the cavity 210.

Figure 3:
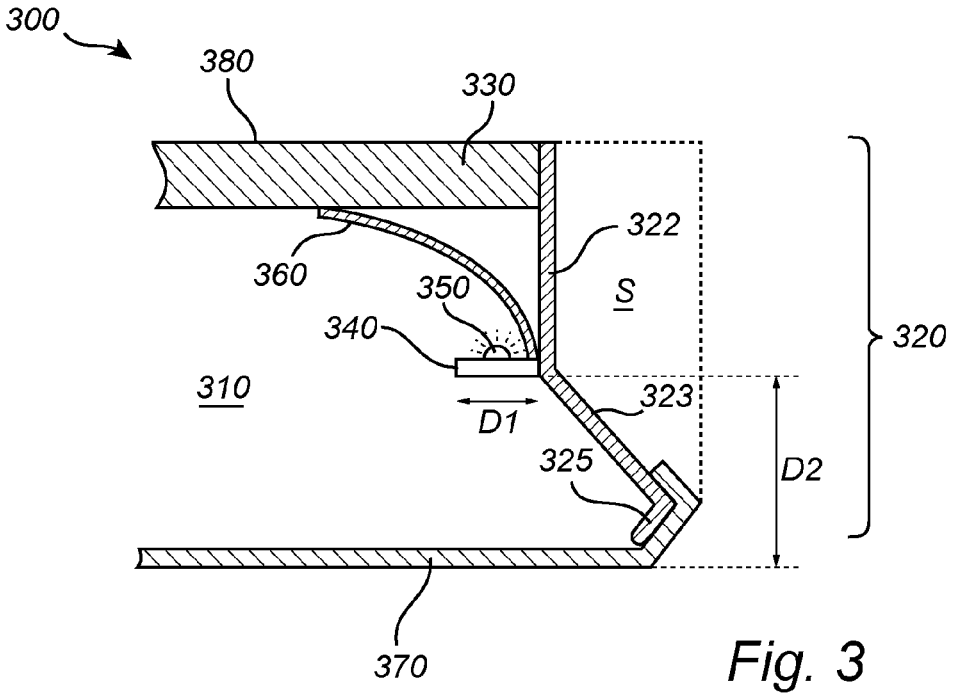
FIG. 3 shows a cross section of parts of an acoustic lighting tile according to a third embodiment.

An acoustic lighting tile according to a third embodiment will be described with reference to FIG. 3, showing a cross section of parts of the acoustic lighting tile. The acoustic lighting tile 300 shown in FIG. 3 may be similarly configured as the acoustic lighting tiles 100 and 200 described with reference to FIGS. 1 and 2, respectively, i.e. it comprises e.g. a cavity 310 with at least one side wall 320, an acoustic element 330, at least one light source carrier 340, at least one light source 350, at least one reflective surface 360, and a diffusing element 370. Moreover, the side wall 320 comprises a first portion 322 extending between the back wall 380 of the cavity 310 and the light source carrier 340 (e.g. PCB), and a second portion 323 extending between the light source carrier 340 and the diffusing element 370 (e.g. surface sheet).

However, in the acoustic lighting tile 300 shown in FIG. 3, the second portion 323 is slanted outwards relative to the first portion 322, away from an interior of the cavity 310. This outward slant may increase the mechanical stiffness (and/or durability/sturdiness) of the acoustic lighting tile 300. The outward slant of the second portion 323 leaves a space S behind it which is at least not directly visible from below, and which may be used for accompanying power supplying components and/or elements for mounting the acoustic lighting tile 300 on a surface (e.g. in a ceiling). In this way, the outward slant of the second portion 323 may be used to at least partially conceal power supplying components and/or elements for mounting the acoustic lighting tile 300, and a system of acoustic lighting tiles 300 may be provided in which light emitting surfaces (i.e. the diffusing elements 370) of the acoustic lighting tiles are arranged closer together, thereby facilitating provision of a more uniform illumination of a room. In particular, the outward slant of the second portion 323 may allow for at least partially concealing a grid into which multiple acoustic lighting tiles 300 are mounted.

The second portion 323 of the side wall 320 may optionally comprise an edge portion 325 which is slanted relative to the rest of the second portion 323, or at least relative to the portion of the second portion 323 which is adjacent to the edge portion 325. The slant of the edge portion 325 may increase mechanical stiffness (and/or durability/sturdiness) of the acoustic lighting tile 300. In FIG. 3, the edge portion 325 is exemplified by a facet 325 slanting inwards towards an interior of the cavity 310. The inward slant of the facet 325 may reduce visibility of height differences between neighboring acoustic tiles 300, in particular when the light sources 350 are switched off. The inward slant of the facets 325 may contribute to reducing edges created when acoustic lighting tiles 300 of different heights are arranged alongside each other. Hence, the inward slant of the facet 325 may allow for use of acoustic lighting tiles 300 with a larger variation of height/thickness.

Figure 4:
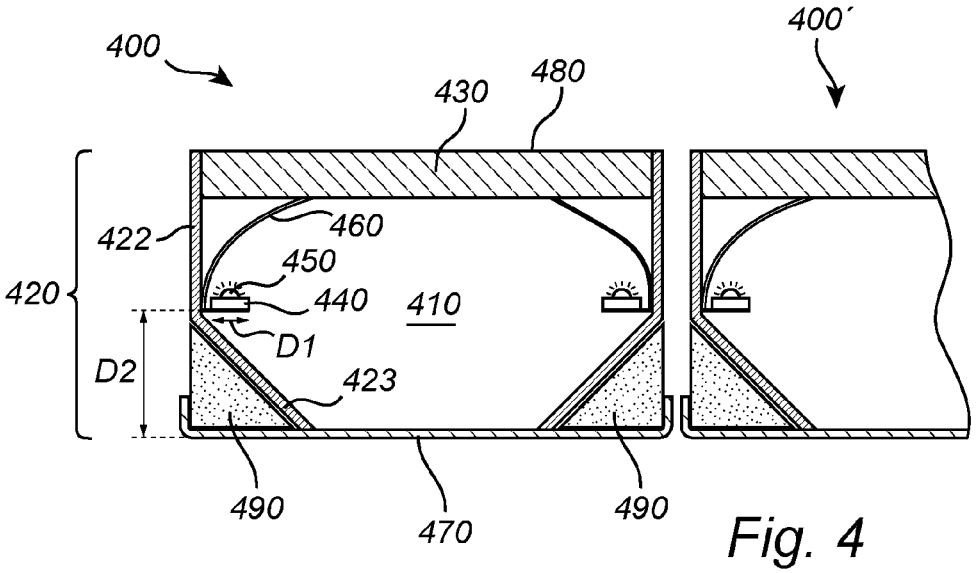
FIG. 4 shows a cross section of two adjacent acoustic lighting tiles according to a fourth embodiment.

An acoustic lighting tile according to a fourth embodiment will be described with reference to FIG. 4, showing a cross section of two adjacent acoustic lighting tiles. The acoustic lighting tile 400 shown in FIG. 4 may be similarly configured as the acoustic lighting tiles 100 and 200 described with reference to FIGS. 1 and 2, respectively, i.e. it comprises a cavity 410 with at least one side wall 420, an acoustic element 430, at least one light source carrier 440, at least one light source 450, at least one reflective surface 460, and a diffusing element 470. Moreover, the side wall 420 comprises a first portion 422 extending between the back wall 480 of the cavity 410 and the light source carrier 440 (e.g. PCB), and a second portion 423 extending between the light source carrier 440 and the diffusing element 470 (e.g. surface sheet).

However, in the acoustic lighting tile 400 shown in FIG. 4, the second portion 423 is slanted inwards relative to the first portion 422, towards an interior of the cavity 410. This inward slant may increase mechanical stiffness (and/or durability/sturdiness) of the acoustic lighting tile 400.

Further, the second portion 423 is at least partially light transmissive, i.e. light transmitted by the lighting devices 450 is allowed to pass through the second portion 423, into a space/region between the acoustic lighting tile 400 and an adjacent acoustic lighting tile 400'. The second portion 423 being at least partially light transmissive facilitates illumination of the space/region between the acoustic lighting tiles 400, 400' and may facilitate provision of a more uniform illumination of the acoustic lighting tiles. The second portion 423 may for example comprise a light transmissive material (e.g. glass or plastic) and/or may comprise one or more apertures (e.g. holes and/or slits).

The acoustic lighting tile 400 shown in FIG. 4 also comprises a second diffusing element 490 arranged on the outside relative to the cavity 410, of the second portion 423. The second diffusing element 490 is adapted to diffuse light transmitted through the second portion 423 and may facilitate a more uniform illumination of the space/region between the acoustic lighting tiles 400, 400'. In FIG. 4, the second diffusing element 490 is exemplified by a volume diffuser 490 (e.g. comprising plastics, foams, and/or mineral wools) filling a space created on the outside of the second portion 423 via the inward slant of the second portion 423.

The diffusing element 470 (e.g. surface sheet) which is arranged to cover the opening of the cavity 410 may be arranged also to cover the second diffusing element 490. By providing a common surface, in the form of the diffusing element 470, from which the light output of the acoustic lighting tile 400 is emitted, a more uniform light output of the acoustic lighting tile 400 may be facilitated.

It is to be noted that acoustic lighting tiles according to embodiments of the present invention may comprise additional mirrors/reflectors, e.g. to improve uniformity of the light output of the acoustic lighting tile. For example, if the acoustic lighting tile 100 described with reference to FIG. 1 is rectangular and comprises light sources 150 arranged along two opposite side walls 120, but not along the remaining two side walls, these remaining two side walls may be at least partially covered by plane mirrors for reflecting light back into the cavity 110. Such plane mirrors may improve uniformity of the light output of the acoustic lighting tile.

The person skilled in the art realizes that the present invention by no means is limited to the preferred embodiments described above. On the contrary, many modifications and variations are possible within the scope of the appended claims. For example, an acoustic lighting tile may comprise an arbitrary number of side walls (e.g. one, two, three or four side walls) and may have many different shapes, the opening of the cavity being directed in any direction. Similarly, embodiments are envisaged wherein the number of light sources, light source carriers and/or reflective surfaces may assume many different values It is to be noted that in at least some embodiments of the acoustic lighting tiles described with reference to FIGS. 1, 2, 3 and 4, the side walls may be used for mounting the corresponding acoustic lighting tiles. In particular, the portion of a side wall, extending at least partway between the light source carrier and the diffusing element, may be used for mounting the acoustic lighting tile.

Additionally, variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. An acoustic lighting tile comprising:

a cavity having a side wall arranged to form an opening in the cavity;

an acoustic element adapted to absorb at least a subset of sound incident to the cavity;

a light source carrier arranged in the cavity along the side wall, wherein the light source carrier extends a first distance along a horizontal direction into the cavity;

a light source mounted on the light source carrier and arranged to emit light in a vertical main direction into the cavity away from the opening of the cavity;

a reflective surface arranged in the cavity and adapted to reflect at least a subset of the emitted light towards the opening; and a diffusing element arranged to at least partially cover the opening at a second distance from the light source carrier and adapted to at least partially diffuse light passing through the opening, wherein the second distance is in a direction perpendicular to that of the first distance and at least as large as the first distance.

2. The acoustic lighting tile as defined in claim 1, wherein the cavity comprises a back wall, and wherein the side wall comprises a first portion extending at least partway between the back wall and the light source carrier; and a second portion extending at least partway between the light source carrier and the diffusing element, said second portion being slanted relative to said first portion.

3. The acoustic lighting tile as defined in claim 2, wherein said second portion is slanted inwards towards an interior of the cavity, relative to said first portion.

4. The acoustic lighting tile as defined in claim 2, wherein said second portion is slanted outwards away from an interior of the cavity, relative to said first portion.

5. The acoustic lighting tile as defined in claim 2, wherein an edge portion of said second portion is slanted relative to a portion of said second portion adjacent to the edge portion.

6. The acoustic lighting tile as defined in claim 1, wherein at least a part of a rim of the side wall is folded, the diffusing element being arranged in abutment to the fold of the rim.

7. The acoustic lighting tile as defined in claim 1, wherein the side wall comprises a portion extending between the light source carrier and the diffusing element, at least part of said portion extending between the light source carrier and the diffusing element being at least partially light transmissive.

8. The acoustic lighting tile as defined in claim 7, wherein said portion extending between the light source carrier.

9. The acoustic lighting tile as defined in claim 1, comprising a second diffusing element arranged on an outside, relative to said cavity, of said portion extending between the light source carrier and the diffusing element, and adapted to at least partially diffuse light passing through said portion extending between the light source carrier and the diffusing element.

10. The acoustic lighting tile as defined in claim 1, wherein at least a portion of the side wall comprises metal.

11. The acoustic lighting tile as defined in claim 1, wherein the reflective surface is curved.

12. The acoustic lighting tile as defined in claim 1, comprising two light source carriers arranged at opposite sides of the cavity.

13. The acoustic lighting tile as defined in claim 1, wherein the acoustic lighting tile is rectangular.

14. The acoustic lighting tile as defined in claim 1, wherein the light source comprises a strip of multiple light sources arranged along the side wall.

15. The acoustic lighting tile as defined in claim 1, wherein the light source comprises a solid state light source.

* * * * *